US007275405B2

(12) United States Patent
Bültmann

(10) Patent No.: US 7,275,405 B2
(45) Date of Patent: Oct. 2, 2007

(54) STRAIGHT DRAWING MACHINE

(75) Inventor: Rudolf Bültmann, Neuenrade (DE)

(73) Assignee: BL Chemie GmbH & Co., KG, Neuenrade (DE)

( * ) Notice: Subject to any disclaimer, the term of this patent is extended or adjusted under 35 U.S.C. 154(b) by 122 days.

(21) Appl. No.: 10/503,291

(22) PCT Filed: Jan. 23, 2003

(86) PCT No.: PCT/DE03/00170

§ 371 (c)(1),
(2), (4) Date: Mar. 8, 2005

(87) PCT Pub. No.: WO03/066250

PCT Pub. Date: Aug. 14, 2003

(65) Prior Publication Data

US 2005/0210948 A1 Sep. 29, 2005

(30) Foreign Application Priority Data

Feb. 5, 2002 (DE) ..... 102 04 519

(51) Int. Cl.
*B21C 1/30* (2006.01)

(52) U.S. Cl. ..... 72/291; 226/112; 226/162

(58) Field of Classification Search ..... 72/290, 72/291, 287; 226/112, 162, 158
See application file for complete search history.

(56) References Cited

U.S. PATENT DOCUMENTS

| | | | | |
|---|---|---|---|---|
| 2,126,453 | A * | 8/1938 | Criley et al. | 72/19.4 |
| 2,880,854 | A * | 4/1959 | Friedman | 72/290 |
| 3,583,268 | A * | 6/1971 | Scribner | 83/225 |
| 3,819,073 | A * | 6/1974 | Asselborn et al. | 414/431 |
| 3,881,339 | A | 5/1975 | Mannell | |
| 4,552,294 | A * | 11/1985 | Rotzler | 226/142 |
| 4,577,483 | A * | 3/1986 | Rehag et al. | 72/214 |
| 4,596,174 | A * | 6/1986 | LaFleur | 83/153 |
| 6,684,675 | B1 * | 2/2004 | Klingen et al. | 72/290 |
| 6,688,152 | B2 * | 2/2004 | Klingen et al. | 72/291 |
| 6,715,332 | B2 * | 4/2004 | Klingen et al. | 72/291 |

FOREIGN PATENT DOCUMENTS

| | | |
|---|---|---|
| DE | 197 03 878 | 11/1997 |
| EP | 1262249 | * 12/2002 |

* cited by examiner

*Primary Examiner*—Daniel C Crane
(74) *Attorney, Agent, or Firm*—Hoffman, Wasson & Gitler, P.C.

(57) ABSTRACT

Rectilinear drawing machine for drawing material, especially bars, pipes or sections, with at least two movable drawing cars which are driven on a path, one run being assigned to each drawing car, and the runs can be fixed in a variable manner.

16 Claims, 4 Drawing Sheets

STRAIGHT DRAWING MACHINE

BACKGROUND OF THE INVENTION

This invention relates to a rectilinear drawing machine for drawing material, especially bars, pipes or sections, with at least two movable drawing cars which are driven on a path, one run being assigned to each drawing car. The invention relates to a process for continuous rectilinear drawing of drawing material by means of a rectilinear drawing machine with at least two drawing cars, the drawing material being drawn by means of at least one drawing car along a run assigned to the drawing car on a path.

Such a drawing machine and such a process for rectilinear drawing of drawing material are known from publication DE 197 03 878 A1.

In the drawing machine disclosed in this publication, on a path, a first drawing car runs, and behind this car, a second drawing car runs, each are each provided with clamps. While one car at a time is drawing, the other is running with increased speed back into its initial position. When the drawing force is transferred from one car to the other, the two cars are synchronously controlled. For this reason, and due to the relatively great length of the clamps which gently grasp the material, in the transfer of the drawing force, from one car to the other, a fall of the drawing speed is avoided.

The disadvantage of the drawing system described in the indicated publication is that invariable lengths of travel are assigned to the individual drawing cars. This results especially in the fact that a continuous feed of drawing material, into the drawing machine, is not possible, or is possible only with great difficulty. So that specifically a continuous feed of drawing material into the drawing machine is possible, the first drawing car must grip the drawing material, spaced so far away from the end of the drawing material that the drawing material, when the first drawing car has reached the end of its run, projects so far into the run of the second drawing car that the second drawing car can pick up and continue to draw the drawing material. This is however very complex, since the drawing material, so that the first drawing car can grasp the drawing material spaced so far away from the end of the drawing material, must either be drawn by hand, relatively far through the drawing die, or the first drawing car in a first cycle grasps the drawing material directly at the drawing die, draws it to the end of its run, then travels back to grasp the drawing material again and to draw it in the direction of the second drawing car.

Therefore it is an object of the invention is to propose a rectilinear drawing machine and a process for operating a rectilinear drawing machine with which continuous feed of the drawing material into a rectilinear drawing machine is easily and quickly possible.

SUMMARY OF THE INVENTION

An object is achieved in that the runs which are assigned to the drawing cars can be fixed in a variable manner. Due to the possibility that the runs of the individual drawing cars are fixed in a variable manner, the drawing cars can be controlled such that the drawing cars, for feed of the drawing material into the drawing machine, are moved as close as possible to the drawing die in order to pick up the drawing material which has been fed into the machine through the drawing die. Further knocking-in, or drawing by hand, thus becomes unnecessary and also feed and regrasping in a first cycle by the first drawing car are then unnecessary.

The runs of the individual drawing cars can be fixed such that they overlap. The runs of the drawing cars can also be changed especially during operation of the rectilinear drawing machine. The rectilinear drawing machine preferably has closed-loop or open-loop control for establishing the runs.

The object is furthermore achieved in that the drawing cars can be driven with an electric linear motor. Here it is advantageous if the path has an inductor and the drawing cars have the armature of the linear motor. In order to enable operation of the linear motor, according to the principle of a synchronous motor, the drawing cars can bear field coils. Advantageously, the inductor has coils which are arranged along and/or on the path. The rectilinear drawing machine can have open-loop or closed-loop control via which current flow through the individual coils which can be controlled independently of one another, by which the runs of the individual drawing cars can be controlled. The coils of the inductor can be turned on independently of one another by the open-loop control, or by the closed loop control, so that a moving field is formed for each drawing car, by which the drawing car is advanced. Because the open-loop or closed-loop control dictates the moving fields, the run of the individual drawing cars can be also fixed by the open-loop or closed-loop control. A constructional action into the drawing machine or modification in the drawing machine is not necessary to do this. Rather the runs can be fixed during operation of the drawing machine by setpoint inputs to the open-loop or closed-loop control.

The drawing cars can be guided mechanically or electromechanically on the path. The coils of the drawing machine (coils of the inductor, field coils, coils for electromagnetic guidance) can be superconductive. In particular, superconductive inductor coils can increase the output of the linear motor so much that drawing speeds are possible which are clearly above the drawing speeds achieved to date. This increase of output is otherwise possible when using a linear motor without superconductive coils compared to the currently conventional drawing machines with conventional electric motors.

An object is furthermore achieved in that in a process for continuous rectilinear drawing of drawing material the runs of the drawing cars during drawing are changed. In particular, in a first cycle, specifically during the feed of the drawing material into the drawing machine, the runs are fixed such that the runs overlap. Then, in the overlapping area, the end of the drawing material can be transferred from the first drawing car to the second drawing car. To transfer the drawing material, the first drawing car can draw the drawing material which is held beforehand in the area of a drawing die to the start of the overlapping area, while there, the second drawing car holds the end of the drawing material and with the first drawing car draws the drawing material to the end of the overlapping area where the first drawing car releases the drawing material. The second drawing car can then draw the drawing material to the end of the run of the second drawing car after accepting the drawing material from the first drawing car. The run of the first drawing car and/or of the second drawing car can be changed after release of the drawing material by the drawing cars for the following cycles.

In particular, the runs of the drawing cars in the following cycles cannot overlap. The rectilinear drawing machine can have more than two drawing cars, two drawing cars which are not directly adjacent to one another at a time being moved synchronously toward one another on the path in order to draw the drawing material through the machine. By synchronous switching of two or more drawing cars at a time, the pulling force of the drawing machine can be multiplied so that higher target outputs can be achieved.

BRIEF DESCRIPTION OF THE DRAWINGS

One embodiment of the invention is detailed using the drawings.

DETAILED DESCRIPTION OF THE INVENTION

Figure 1:
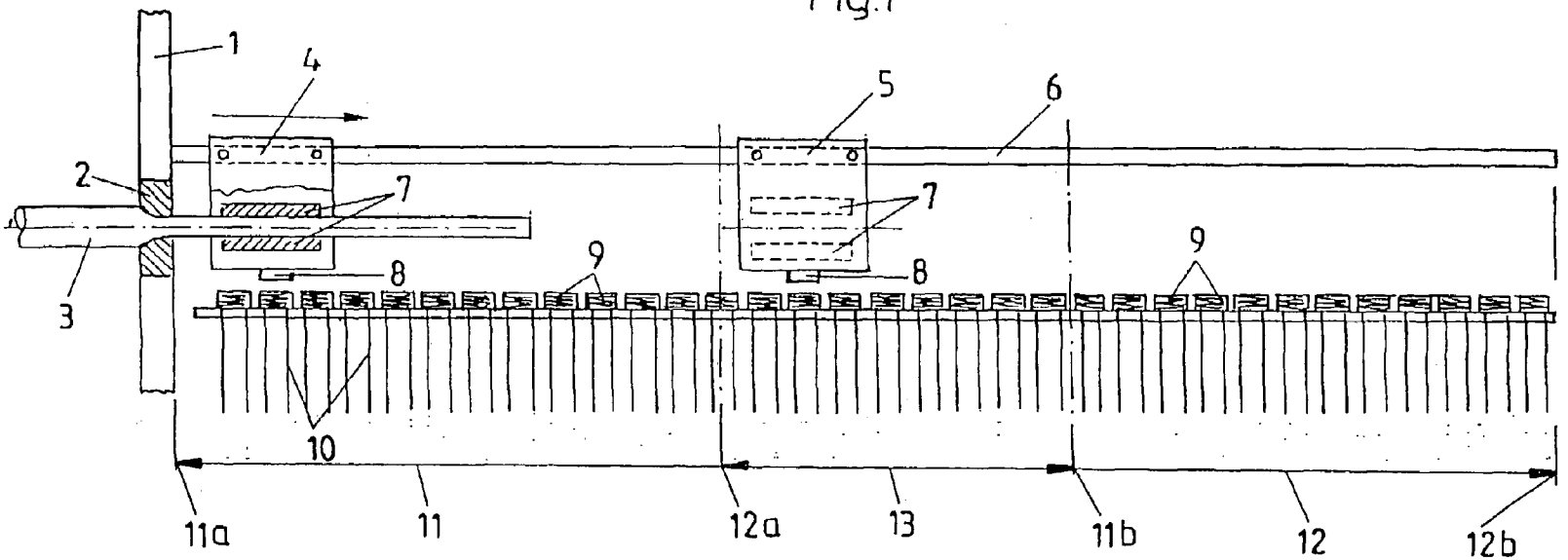
FIG. 1 shows a side view of a rectilinear drawing machine at the start of feed of the drawing material (first cycle)

A rectilinear drawing machine, as shown in FIGS. 1 to 4, has a matrix 1 onto which a drawing die 2 is inserted. This drawing die draws a drawing material from a larger cross section to a smaller cross section. To do this, the drawing machine has a first drawing car 4 and a second drawing car 5 which are guided on a rod 6. The drawing cars 5 and 6, are provided with clamps 7 with which the drawing cars grasp the drawing material and draw it through the drawing die 3. The drawing cars 4 and 5 furthermore have an iron plate 8 which forms the armature of a linear motor. The linear motor is completed by coils 9 which form the inductor of the linear motor. The coils 9 are connected by power supply lines 10 via an open-loop or closed-loop control unit (not shown) to the power supply unit. The drawing cars 4, 5 are assigned a run 11, 12.

Figure 2:
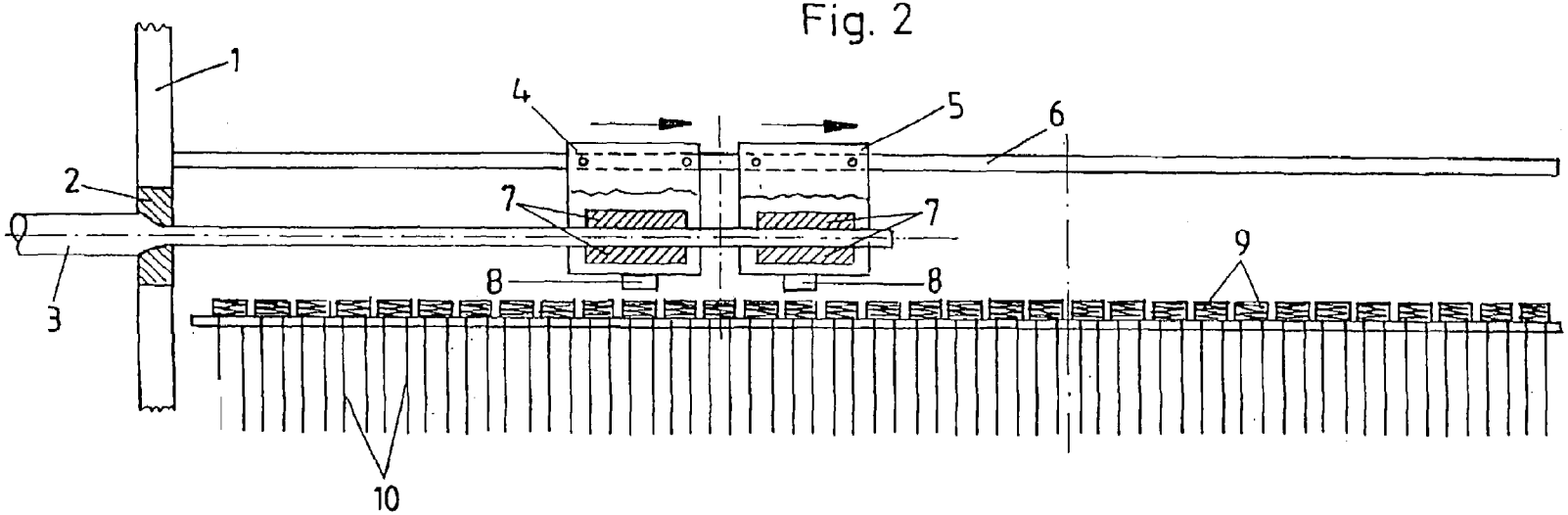
FIG. 2 shows the rectilinear drawing machine as shown in FIG. 1 during the first cycle, but at a later state of feed.
Figure 3:
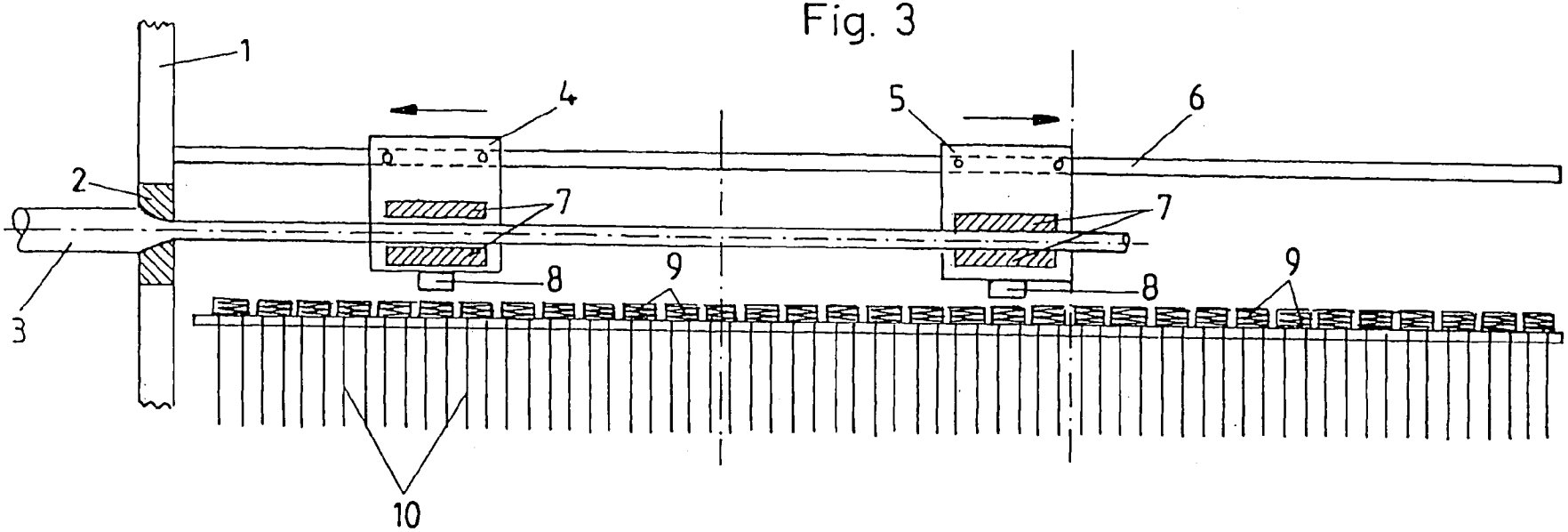
FIG. 3 shows the rectilinear drawing machine as shown in FIGS. 1 and 2 during the first cycle after transfer of the drawing material to the second drawing car.

Before the feed of the drawing material into the rectilinear drawing machine is described using FIGS. 1 to 3, the operation of the rectilinear drawing machine in cycles after feed, i.e. after the first cycle, will be explained using FIGS. 4 and 5.

The two drawing cars 4, 5 move in a cycle fundamentally in opposite directions after the first cycle, one car at a time drawing the drawing material over the run, while the clamps 7 hold the drawing material and at the same time the other drawing car with the clamps opened travels back into its starting position at the start of the run.

The drawing cars 4, 5 are controlled in such a way that when the drawing material 3 is transferred from one drawing car to the other, they run synchronously with the same drawing speed. This phase of transfer from the first drawing car 4 to the second drawing car 5 is labelled with reference numbers 22, 23 in FIG. 5. During the transfer, the drawing material is held for a short time interval in the two drawing cars by the clamps 7. Immediately after completed transfer the clamps 7 of the first drawing car 4 release the drawing material, this car returns with high speed while continuous drawing is undertaken by the second drawing car 5.

Figure 5:
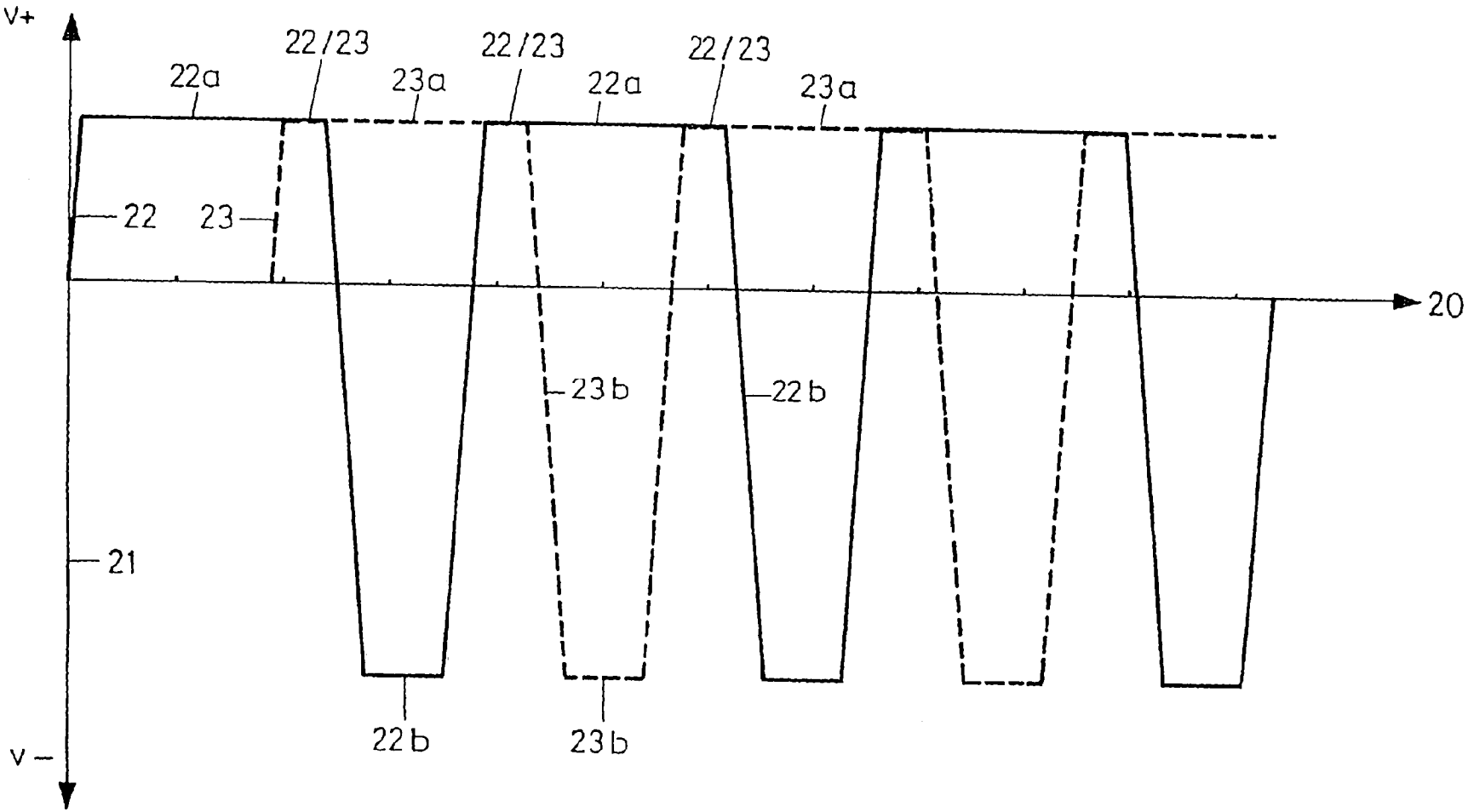
FIG. 5 shows the velocity-time diagram of the first and the second drawing car during one cycle.

In the velocity-time diagram as shown in FIG. 5 of the two drawing cars the x-axis 20 plots the time t while the y-axis 21 plots the velocity v. The diagram of the first drawing car 4 is shown by solid lines, while the diagram of the second drawing car 23 is shown by broken lines. The phases in which the drawing cars each draw the drawing material through the drawing machine are shown by 22*a* and 23*a*. The phases of the transfer of the drawing material from the first to the second drawing car is labeled 22/23. The phase of return of the first drawing car 4 from the end of the run 11 to the start 11*a* of the run 11 is labeled 22*b*, while 22*b* shows the return of the second drawing car 5 from the end 12*b* to the start 12*a* of the run 12. The tilted flanks of the diagram represent the phases of acceleration and deceleration. Horizontal segments in the diagrams show uniform motion of the drawing cars 4, 5. Here the reference numbers 22*a* and 23*a* and 22/23 show forward motion from the start of one run to its end, while reference numbers 22*b* and 23*b* identify the return trip of the drawing cars 5, 6.

Figure 4:
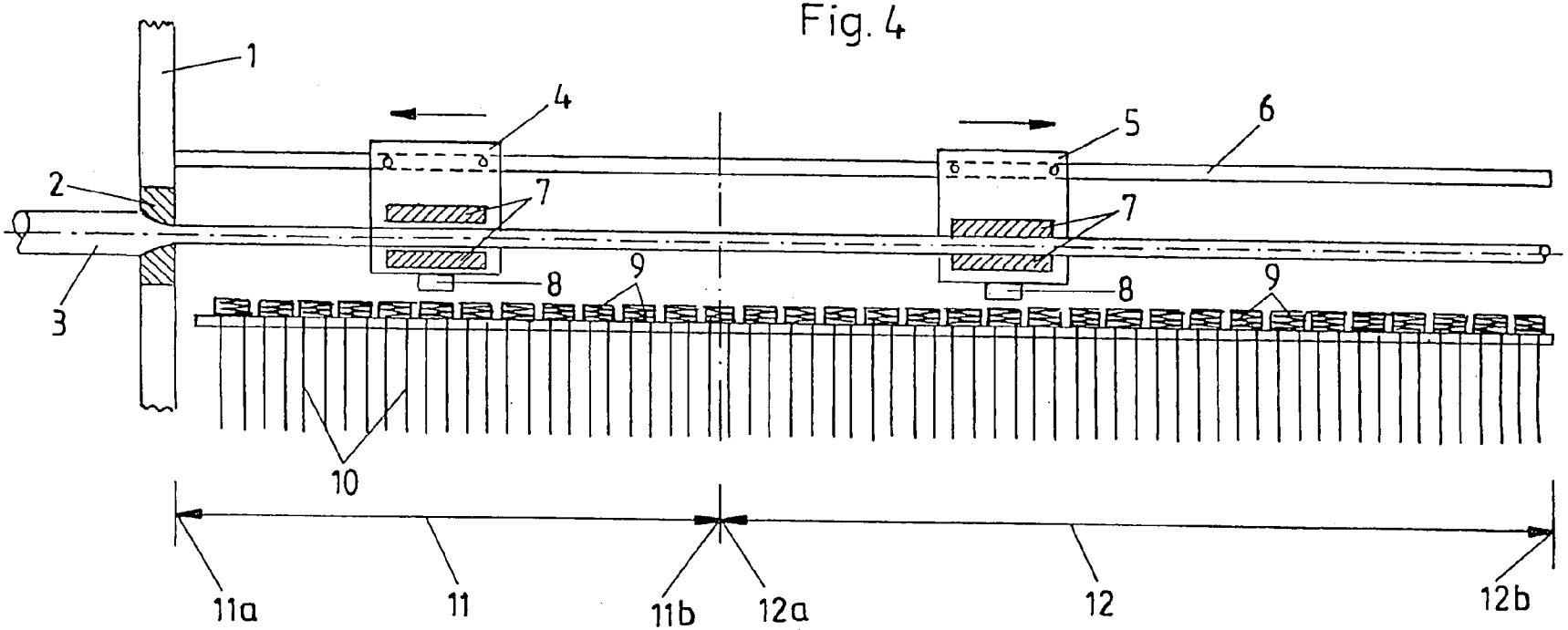
FIG. 4 shows the rectilinear drawing machine as shown in FIGS. 1 and 3 in a cycle after feed.

During the continuous drawing, which is described using FIGS. 4 and 5, in cycles after the first cycle, the coils 9 of the inductor are triggered such that there are two nonoverlapping, directly abutting runs 11, 12 for the drawing cars 4 and 5. The moving fields which drive the drawing cars 4 and 5 and which are produced by the coils 9 of the inductor therefore do not go beyond the start or the end of the runs 11, 12.

The feed of the drawing material 3 into the rectilinear drawing machine will be described at this point using FIGS. 1 to 3. During feed in a first cycle, the coils 9 of the inductor are triggered such that the runs 11, 12 of the drawing cars 4, 5 overlap. The moving fields are limited here to the individual runs 11, 12, but can also creep into the region of the run of the other drawing car. The runs are established by the open-loop or closed-loop control unit, which is not shown, and which turns the coils 9 of the inductor on and off such that the desired moving field for driving the drawing cars 4, 5 is formed.

In FIG. 1, the drawing cars 4, 5 are each at the start 11*a*, 12*a* of the lengths of their travel 11, 12. The drawing material 3 is fed through by the drawing die 2 into the machine and has already been grasped by the clamps 7 of the first drawing car 4. In doing so, the end of the drawing material 3 projects out of the first drawing car 4 in the drawing direction. The second drawing car 5 is located at the start 12*a* of the run 12 which is assigned to it. The clamps 7 of the drawing car 5 are opened. The drawing car 4 is moved along the run by a moving field which has been produced by the coils 9 of the inductor and thus draws the drawing material 3 which has been clamped in the clamps 7. As soon as the drawing car 4 approaches the start 12*a* of the run, which is assigned to the second drawing car 5, it automatically feeds the drawing material 3 into the second drawing car 5. The second drawing car 5 accelerates and as soon as it has reached the speed of the first drawing car 4, or of the drawing material 3, the jaws 7 of the second drawing car 5 are closed. The two drawing cars 4 and 5 now simultaneously draw the drawing material 3 to the end 11*b*, 12*b* of their respective runs 11, 12. As soon as the first drawing car 4 has reached the end 11*b* of its run 11, the clamps 7 of the first drawing car 4 are opened and the second drawing car 5 alone assumes drawing of the drawing material 3.

The drawing car 4, with the clamps 7 opened, travels back to the start 11*a* of its run 11 (FIG. 3) while the second drawing car draws the drawing material to the end 12*b* of its run. As soon as the first drawing car has reached the start 11*a* of its run 11, the feed of the drawing material 3 into the drawing machine is ended. The open-loop or closed-loop control unit in the following cycles now triggers the coils 9 of the inductor such that there is no overlapping area 13 between the runs 11 and 12. The runs 11 and 12 rather abut one another without an overlapping area, as already described using FIG. 4.

What is claimed is:

1. A rectilinear drawing machine for drawing material with at least two movable drawing cars which are driven on a path, one run being assigned to each drawing car, the path has an inductor and the drawing cars have an armature of the linear motor, the drawing cars have field coils, the coils being entirely or partially superconductive.

2. A rectilinear drawing machine as claimed in claim 1, wherein the runs are fixed such that the runs overlap.

3. A rectilinear drawing machine as claimed in claim 1, wherein the runs are fixed during operation of the rectilinear drawing machine.

4. A rectilinear drawing machine as claimed claim 1, wherein the rectilinear drawing machine has closed-loop or open-loop control for establishing the runs.

5. A rectilinear drawing machine, for drawing material as claimed in claim 1, wherein the at least two movable drawing cars driven with a linear motor.

6. A rectilinear drawing machine as claimed in claim 5, wherein the path has an inductor and the drawing cars have an armature of the linear motor.

7. A rectilinear drawing machine as claimed in claim 6, wherein the inductor has coils which are arranged along and/or on the path.

8. A rectilinear drawing machine as claimed in claim 7, wherein the rectilinear drawing machine has open-loop or closed-loop control via which current flow through the coils is controlled independently of one another, by which the runs of the individual drawing cars are controlled.

9. A process for continuous rectilinear drawing of drawing material, by means of a rectilinear drawing machine with at least two drawing cars, comprising drawing the material by means of at least one drawing car along the run assigned to the drawing car on a path, the oath has an inductor and the drawing cars have an armature of the linear motor, the drawing cars have field coils, the coils being entirely or partially superconductive wherein the runs of the at least two drawing cars are changed during drawing.

10. The process as claimed in claim 9, wherein in a first cycle, specifically during a feed of the drawing material into the drawing machine, runs which are fixed such that the runs overlap.

11. The process as claimed in claim 10, wherein in the overlapping area of the runs the end of the drawing material is transferred from the first drawing car to the second drawing car.

12. The process as claimed in claim 11, wherein to transfer the drawing material, the first drawing car draws the drawing material which is held beforehand in the area of a drawing die to the start of the overlapping area, wherein there the second drawing car picks up the end of the drawing material and with the first drawing car draws the drawing material to the end of the overlapping area where the first drawing car releases the drawing material.

13. The process as claimed in claim 12, wherein the second drawing car draws the drawing material to an end of the run of the second drawing car after taking over the drawing material from the first drawing car.

14. The process as claimed in claim 12, wherein the run of the first drawing car and/or of the second drawing car is changed after release of the drawing material by the drawing cars for the following cycles.

15. The process as claimed in claim 14, wherein the runs of the at least two drawing cars in the following cycles do not overlap.

16. The process as claimed in claim 9, wherein the rectilinear drawing machine has more than two drawing cars, two of the drawing cars, which are not directly adjacent to one another at a time, are moved synchronously toward one another on the path.

* * * * *